United States Patent [19]

Baumwolspiner

[11] 4,163,120

[45] Jul. 31, 1979

[54] VOICE SYNTHESIZER

[75] Inventor: Milton Baumwolspiner, Brooklyn, N.Y.

[73] Assignee: Bell Telephone Laboratories, Incorporated, Murray Hill, N.J.

[21] Appl. No.: 894,042

[22] Filed: Apr. 6, 1978

[51] Int. Cl.[2] ..... G10L 1/00

[52] U.S. Cl. ..... 179/1 SM

[58] Field of Search ..... 179/1 SM, 1 SH, 1 SA, 179/15.55 T

[56] References Cited

U.S. PATENT DOCUMENTS

| | | | |
|---|---|---|---|
| 3,104,284 | 9/1963 | French et al. | 179/1 SM |
| 3,641,496 | 2/1972 | Slavin | 179/1 SM |
| 3,828,132 | 8/1974 | Flanagan et al. | 179/1 |
| 3,892,919 | 7/1975 | Ichikawa | 179/1 SM |
| 3,908,085 | 9/1975 | Gagnon | 179/1 SM |
| 4,069,970 | 1/1978 | Buzzard et al. | 179/1 SM |

OTHER PUBLICATIONS

B. Atal et al., "Speech Analyses and Synthesis," J. Ac. Soc. Am., 50, 637–655, 1971.

W. Atmar, "The Time Has Come to Talk," Byte #12, Byte Co., Aug. 1976, pp. 26–33.

D. Rice, "Friends, Humans, Countryrobots," Byte #12, Byte Co., Aug. 1976, pp. 16–24.

K. Nakata et al., "A Method of Speech Synthesis," Elec. Comm. Japan, 52-C, 126–134, 1969.

L. Rabiner, "A Hardware Realization of a Digital Synthesizer," IEEE Trans. Comm. Tech., Dec. 1971, pp. 1016–1019.

*Primary Examiner*—Kathleen H. Claffy

*Assistant Examiner*—E. S. Kemeny

*Attorney, Agent, or Firm*—Richard B. Havill

[57] ABSTRACT

The speech synthesizer minimizes storage requirements by storing basis functions each defining a waveform segment or phoneme within a pitch period and including formants F1 and F2, featuring readin at one rate and readout at different rates within the pitch period. The synthesizer is characterized by each basis function being represented by a data point plotted on a single line on a chart having first and second formant log-log axes and means for producing a speech waveform segment approximately representing any desired point located off of the single line on the chart by selecting and reading out of the memory one of the basis functions at a rate different than the basic storage rate.

6 Claims, 21 Drawing Figures

FIG. 6

TABLE A
WORD DATA POINTS

| WORD: | "WHO" | | |
|---|---|---|---|
| POINT 1 | $d_2(m)$ | $d_1(n)$ | 55 |
| POINT 1 | PITCH PERIOD | | 65 |
| POINT 1 | AMPLITUDE | | 70 |
| POINT 2 | $d_2(m)$ | $d_1(n)$ | |
| POINT 2 | PITCH PERIOD | | |
| POINT 2 | AMPLITUDE | | |
| POINT 3 | $d_2(m)$ | $d_1(n)$ | |
| POINT N | $d_2(m)$ | $d_1(n)$ | |
| POINT N | PITCH PERIOD | | |
| POINT N | AMPLITUDE | | |

FIG. 7

TABLE I
BASIS FUNCTION ADDRESSES

| BASIS FUNCTION | |
|---|---|
| $d_1(0)$ | LOW BYTE |
| $d_1(0)$ | HIGH BYTE |
| $d_1(1)$ | LOW BYTE |
| $d_1(1)$ | HIGH BYTE |
| $d_1(12)$ | LOW BYTE |
| $d_1(12)$ | HIGH BYTE |
| $d_1(13)$ | LOW BYTE |
| $d_1(13)$ | HIGH BYTE |

FIG. 8

TABLE 2
BASIS FUNCTION DATA

| BASIS FUNCTION | | |
|---|---|---|
| $d_1(0)$ | AMPL. SAMPLE | 0 |
| | " | 1 |
| | " | 2 |
| | " | 3 |
| | " | 4 |
| | " | 144 |
| $d_1(0)$ | " | 145 |
| $d_1(1)$ | AMPL. SAMPLE | 0 |
| | " | 1 |
| | " | 2 |
| $d_1(1)$ | " | 145 |
| $d_1(2)$ | AMPL. SAMPLE | 0 |
| $d_1(12)$ | " | 145 |
| $d_1(13)$ | AMPL. SAMPLE | 0 |
| | " | 1 |
| | " | 2 |
| | " | 144 |
| $d_1(13)$ | AMPL. SAMPLE | 145 |

VOICE SYNTHESIZER

TECHNICAL FIELD

This invention relates to a voice synthesizer which stores basis functions representing some speech waveforms and produces other speech waveforms by means of either time compression or time expansion of the stored basis functions.

BACKGROUND OF THE INVENTION

The employment of many large scale electronic computer systems for performing a wide variety of computational and logical manipulations on sets of data has led to a recognition that a voice response to human users is a desirable feature. Many electronic systems research and development organizations are attempting to develop a practical system for synthesizing speech by means of a voice waveform synthesizer. Because of the synthesis techniques and compilation systems used, voice synthesizers have either an undesirably small vocabulary, or poor sound quality, or are so costly to build and operate that they are impractical for many desired commercial applications.

For instance, hardware has been developed for synthesizing speech in real time by concatenating formant data. Although such hardware can produce high quality speech, relatively complex and expensive arrangements of equipment are required. *Electron. Commun. Japan,* 52-C, 126–134, (1969); *IEEE Trans. on Comm. Tech.,* Vol. COM-19, No. 6, 1016–1020, (Dec. 1971); U.S. Pat. No. 3,828,132; and BYTE, No. 12, 16–24 and 26–33, (Aug. 1976).

Speech also has been synthesized by linear prediction of the speech waveform. This method of speech generation produces higher quality speech than the aforementioned arrangements but requires more memory as well as relatively complex and expensive equipment arrangement. *Acoust. Soc. of Amer.,* 50, 637–655, (1971).

There is a need, therefore, for a simple voice synthesizer which inexpensively produces a relatively large vocabulary of high quality sounds.

It is an object of the invention to develop a voice waveform synthesizer.

It is still another object to provide a voice synthesizer which produces acceptably good quality sounds.

It is a further object to develop an inexpensive voice synthesizer having a relatively large vocabulary.

It is a still further object to advantageously employ a microprocessor in a good quality voice synthesizer.

SUMMARY OF THE INVENTION

These and other objects are realized in a voice synthesizer arranged with a memory for storing basis functions, each basis function including a set of data representing a speech waveform segment recorded at a basic storage rate and each basic function defining a waveform segment including plural formants F1 and F2. The synthesizer is characterized by each basis function being represented by a data point plotted on a single line on a chart having first and second formant log-log axes and means for producing a speech waveform segment approximately representing any desired point located off of the line on the chart by selecting and reading out of the memory one of the basis functions at a rate different than the basic storage rate.

It is a feature of the invention to store plural basis functions, each representing a selected speech waveform segment recorded at a basic rate, and to produce another speech waveform segment by selecting and reading out a selected one of the stored basis functions at a rate different than the basic storage rate thereby producing a desired waveform segment different than the stored waveforms but within the relevant formant frequency space.

It is another feature to select speech waveform segments for the basis functions as points on a straight line having a slope $m=-1$ on formant F1 and F2 log-log axes so that time compression or time expansion of the basis functions effects formants F1 and F2 characteristics proportionately.

It is still another feature having a microprocessor control generation of desired waveform segments for producing voice sounds rather than utilizing a larger computer.

It is a further feature to time compress or time expand stored waveform segment data for producing waveform segments approximately representing data points located off of the single line on the log-log axes so that a limited amount of stored data can be utilized to represent desired waveform segments throughout the relevant formant frequency space.

BRIEF DESCRIPTION OF THE DRAWINGS

The invention will be more fully understood from the following detailed description of an illustrative embodiment thereof when that description is read in connection with the attached drawings wherein

FIG. 6 is a Table A showing the organization of information relating to data points representing a selected word;

FIG. 7 is a Table 1 which presents a list of basis function addresses;

FIG. 8 is a Table 2 which presents basis function data; and

DETAILED DESCRIPTION

Figure 1:
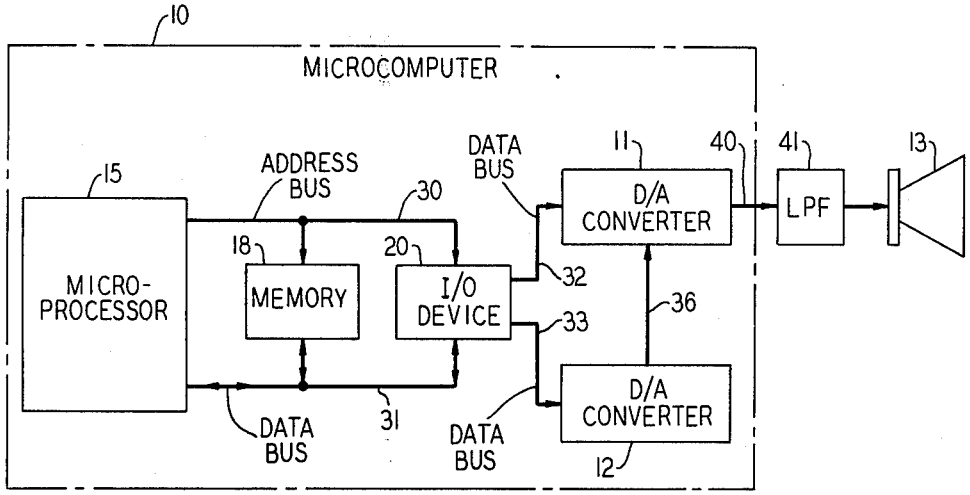
FIG. 1 is a block diagram of a voice synthesizer.

Referring now to FIG. 1 there is shown an exemplary embodiment of a voice synthesizer system. This system includes a microcomputer 10 having first and second digital-to-analog (D/A) converters 11 and 12 for applying an output analog signal to a speaker 13. The microcomputer includes a microprocessor 15 interconnected with some memory 18 and with an input/output (I/O) device 20 interposed between the microprocessor 15 and the digital-to-analog converters 11 and 12.

The illustrated memory includes both random access memory (RAM) and read only memory (ROM).

As it is to be described in more detail hereinafter, the memory 18 stores a plurality of sets of data, or basis functions, wherein each of the sets represents a speech waveform segment recorded at a basic storage rate. This storage may be accomplished by storing digitally coded amplitude samples of the analog waveform, the samples being determined at a uniform basic sampling rate. Each set of data defines a waveform including two or more formants, which are harmonics occurring in voice sounds and which are mathematically modeled by expressions representing time dependent variations of speech amplitude. These expressions vary from one sound to another. The microprocessor 15, the input-/output device 20, the digital-to-analog converters 11 and 12 and the speaker 13 cooperate to produce a speech waveform by selecting and reading out a sequence of selected ones of the encoded recorded waveform segments, converting them into analog waveform segments and concatenating the analog segments into a voice sound.

By means of other information stored in the memory 18 and also selected by the microprocessor 15, the recorded waveforms can be read out of memory at the basic sampling, or storage, rate or at a different rate than the basic storage rate. By reading out the waveforms at a rate that is different than the basic storage rate, it is possible to span the appropriate frequency spectrum for quality voice production with a small number of recorded sampled voice waveform segments. By so limiting the number of recorded voice waveform segments, it is possible to produce quality sounds for a large vocabulary with relatively little memory and at low cost. The cost, however, will be related to the size of the vocabulary desired because each word sound to be produced must be described by a list of data points.

Cost also is limited because a microprocessor, rather than a larger more expensive computer, controls the sound production operation. The microprocessor 15 is capable of controlling the production of voice sounds because the principal operations of the system are limited to controlling the rate of memory readout to the digital-to-analog converters 11 and 12 without the need for any time consuming arithmetic operations.

Before proceeding with the description of the synthesizer apparatus, it will be helpful to digress into some of the theory upon which the voice waveform synthesizer system is based. A good basic understanding of how humans produce sounds and of how synthetic speech waveforms are produced in the prior art can be derived from the previously mentioned articles starting on pages 16 and 26 in the August 1976 edition of *BYTE* magazine.

Acoustical characteristics of voiced sound waveforms are determined by the characteristics of the voice tract which includes a tube wherein voiced sounds are produced. A voiced sound is produced by vibrating a column of air within the tube. The air column vibrates in several modes, or resonant frequencies, for every voiced sound uttered. These modes, or resonant frequencies, are known as formant frequencies F1, F2, F3, ... Fn. Every waveform segment, for any voiced sound uttered, has its own formant frequencies which are numbered consecutively starting with the lowest harmonic frequency in that segment.

Acoustical characteristics of unvoiced speech sound waveforms are determined differently than the voiced sounds. The unvoiced sounds typically are produced by air rushing through an opening. Such a rush of air is modeled as a burst of noise.

Complete sound waveforms of speech utterances can be generated from a finite number of selected speech waveform segments. These waveform segments are concatenated sometimes by repeating the same waveform segment many times and at other times by combining different waveform segments in succession. Either voiced sounds or unvoiced sounds or both of them may be used for representing any desired uttered sound.

Figure 2:
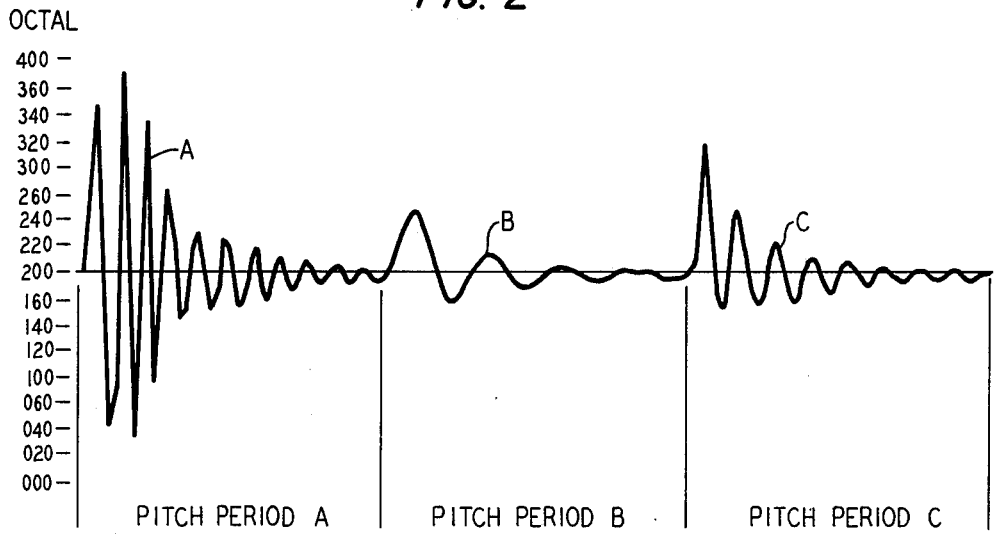
FIG. 2 shows an exemplary complete sound waveform.

As shown in FIG. 2, an exemplary complete sound waveform consists of a concatenation of various voiced waveform segments A, B, and C. Each waveform segment lasts for a time called a pitch period. The duration of the pitch period can vary from segment to segment. Depending upon the complete voiced sound being modeled, the shape of the waveform segments for successive pitch periods may be similar to one another or may be different. For many sounds the successive waveform segments are substantially different from one another. To model the complete sound waveform, the successive waveform segments A, B, and C are concatenated at the end of one pitch period and the beginning of the next whether the first waveform is completely generated or not. If the waveform is completely generated prior to the end of its pitch period, the final value of the waveform is retained until the next pitch period commences.

Although unvoiced sounds are part of typical speech waveforms none are included in FIG. 2. The mathematical model for voiced and unvoiced sounds is a function in the complex frequency domain. For voiced vowel sounds an appropriate mathematical model has been determined to be a Laplace transform. If Laplace transforms of the speech waveform segments are used, a waveform segment Laplace transformation H(s) is expressed as $$H(s) = \frac{\omega_1^2}{(s^2 + b_1 s + \omega_1^2)} \cdot \frac{\omega_2^2}{(s^2 + b_2 s + \omega_2^2)} \cdots \frac{\omega_n^2}{(s^2 + b_n s + \omega_n^2)},$$

$$\text{where } H_n(s) = \frac{\omega_n^2}{(s^2 + b_n s + \omega_n^2)}$$

for specific formants.

$\omega_n = 2\pi(\mathrm{Fn})$,

Fn = frequency of the nth formant, $b_n$ = the bandwidth associated with the formant frequency having the same numerical designator n, and s = the complex frequency operator.

The foregoing expression for the formant frequency Fn can be converted to a time domain expression by taking an inverse Laplace transform.

$$f_n(t) = L^{-1}[H_n(s)].$$

Each speech waveform segment is a convolution of the frequency domain expressions representing all of the appropriate formants.

The complete speech waveform has an inverse Laplace transform resulting in a composite time waveform f(t), of a number of convolved, damped sine waveform segments, such as those shown in FIG. 2. Complete waveforms of voiced sounds therefore are a succession of damped sine waveforms which can be modeled both mathematically and actually. Important parameters used for describing individual speech waveform segments are the formant frequencies, the duration of the pitch period, and the amplitude of the waveform.

There is a problem in actually modeling the complete waveforms because to obtain a good quality model designers of voice synthesizers try to accurately model the complete waveform for every voiced and unvoiced sound. These sounds, however, are spread over a wide range of first and second formant frequencies bounded by the limits of the audible frequency range. To successfully complete the synthesis process within some reasonable amount of storage capacity, prior art synthesis systems have stored data representing a selected matrix of points in the parameter space having formants F1 and F2 as the coordinate axes. The number of points has been a fairly large number.

Prior art modeling of voiced and unvoiced sounds has been accomplished by either (1) making an analog recording of complete waveforms and subsequently reproducing those analog waveforms upon command; (2) taking amplitude samples of complete sound waveforms, analog recording those amplitude samples of complete sound waveforms, and subsequently reproducing the complete analog waveforms from the recorded samples; (3) making an analog recording of many waveform segments and subsequently combining selected ones of the recorded waveform segments to produce a desired complete analog waveform upon command; or (4) taking amplitude samples, digitally encoding those samples, recording the encoded samples, subsequently reproducing analog waveform segments from selected ones of the recorded encoded samples and combining the reproduced waveform segments to produce a desired complete analog waveform upon command.

Unvoiced fricatives have been modeled mathematically as a white noise response of a fricative, pole-zero network. Several different pole-zero network models have been used to generate different fricative sounds such as "s" and "f".

The present invention is best shown in contrast to the aforementioned prior art by describing the illustrative embodiment wherein only a few waveform segments are sampled and recorded for subsequent construction of complete analog sound waveforms. These recorded waveform segments are called basis functions.

Figure 3:
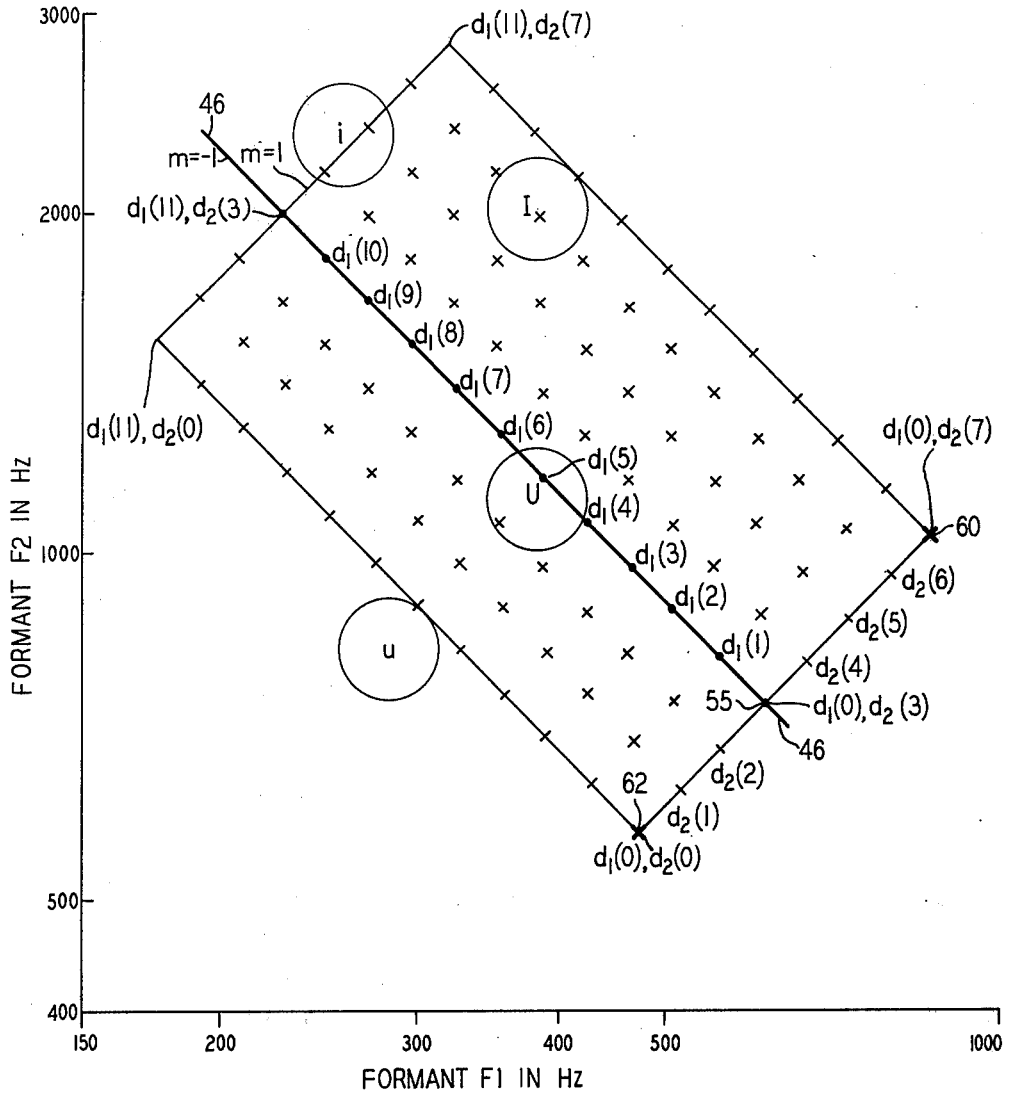
FIG. 3 is a plot of basis function data points on a log-log plot of formant frequencies.
Figure 4A:
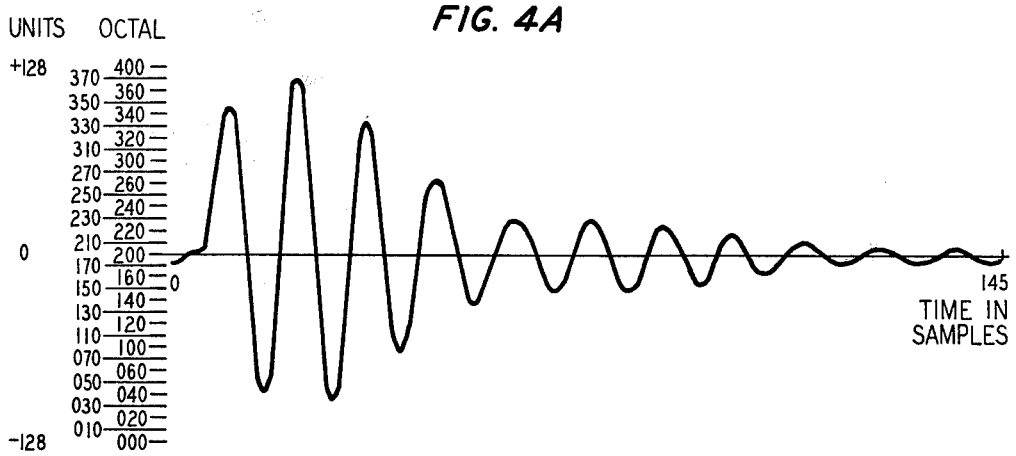
FIGS. 4A through 4L show the basis function waveform segments represented by data points on the log-log plot of FIG. 3.
Figure 4B:
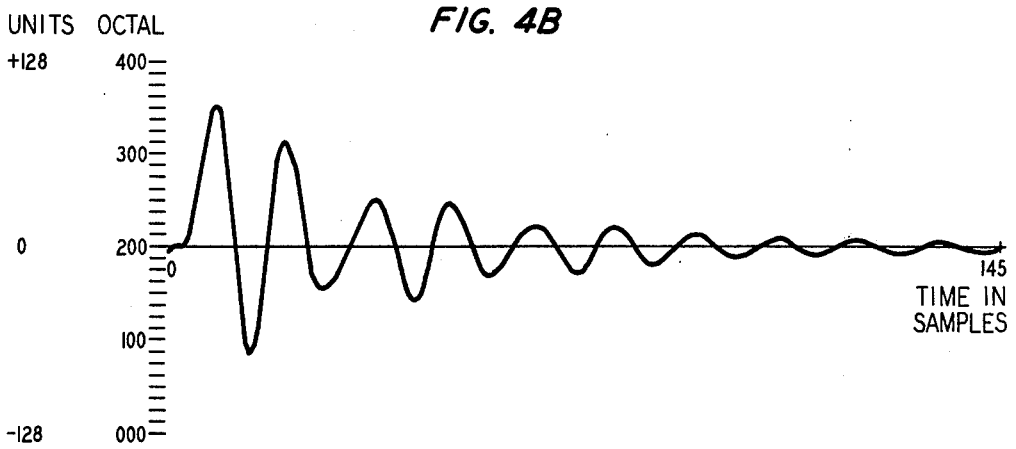
Figure 4C:
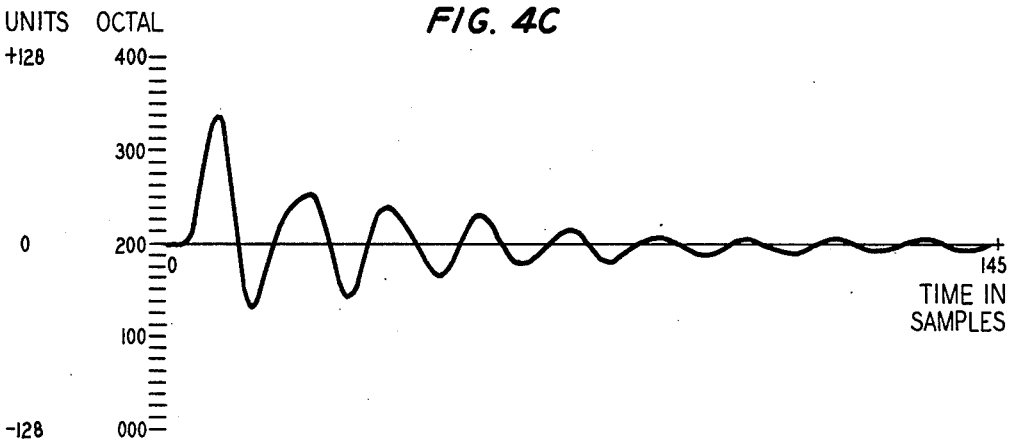
Figure 4D:
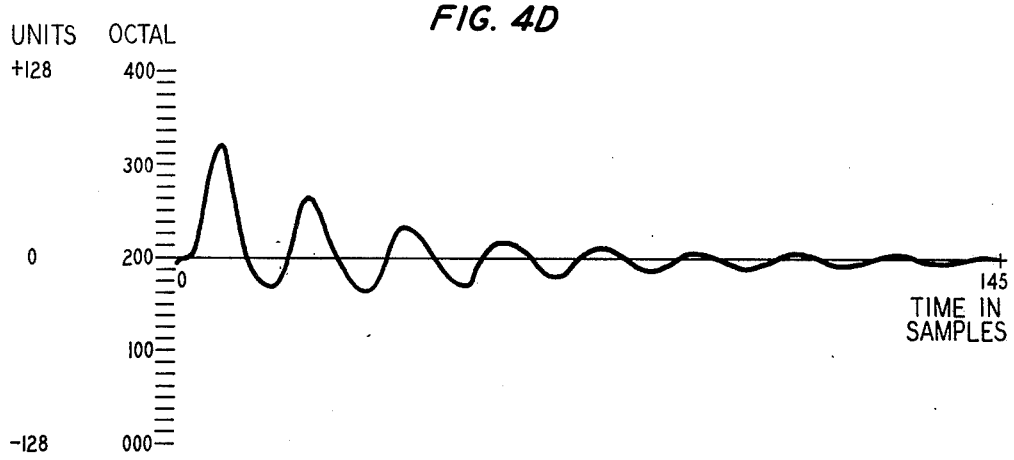
Figure 4E:
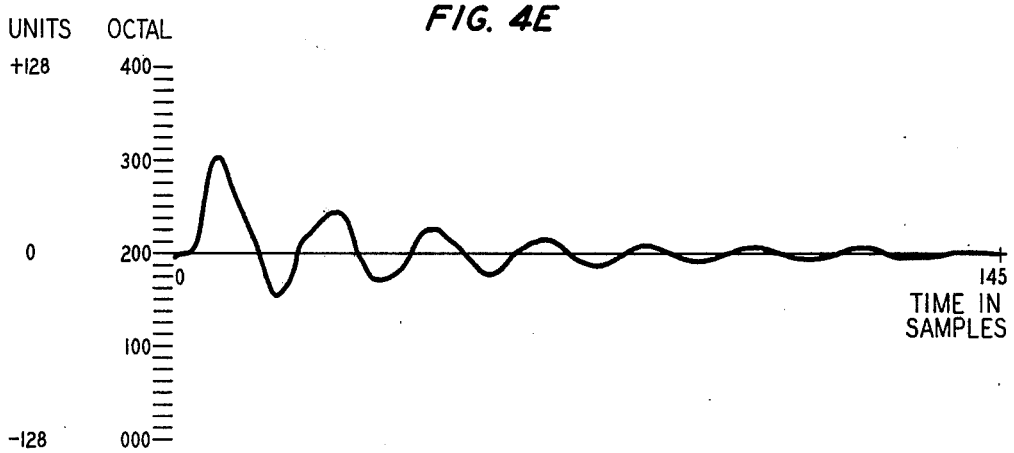
Figure 4F:
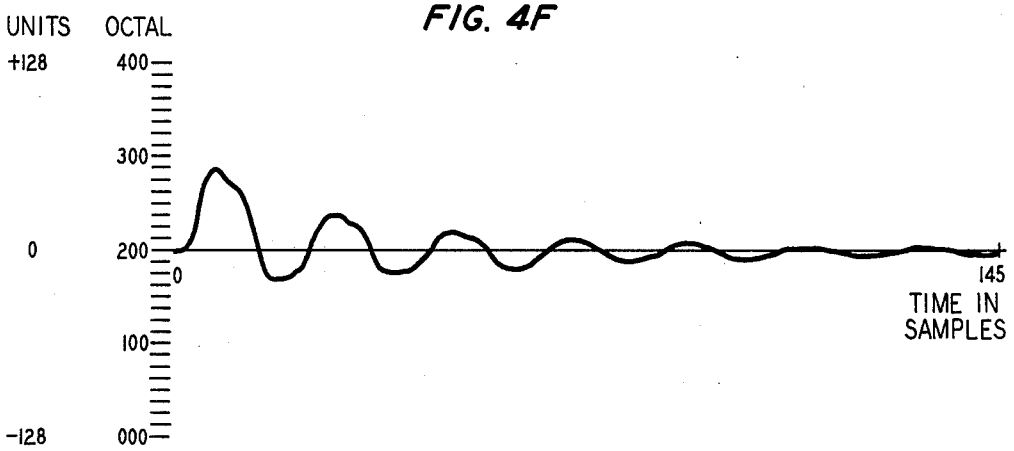
Figure 4G:
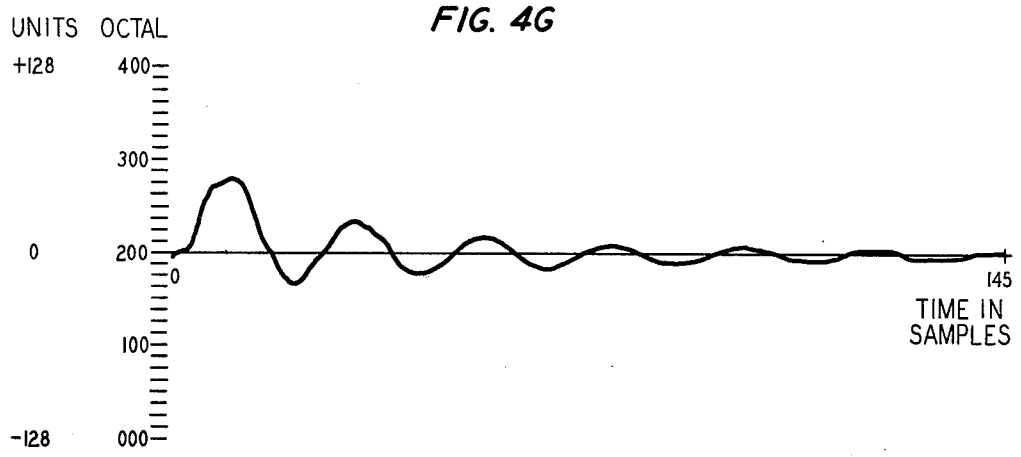
Figure 4H:
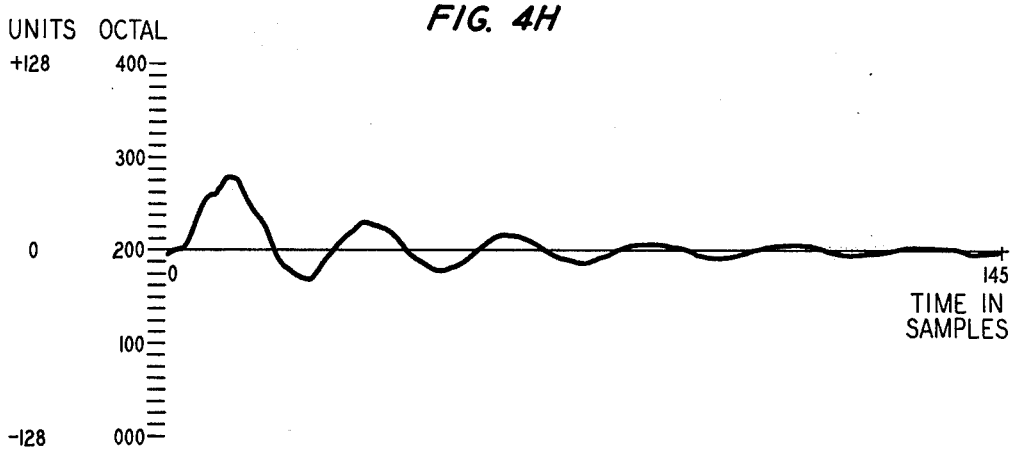
Figure 4I:
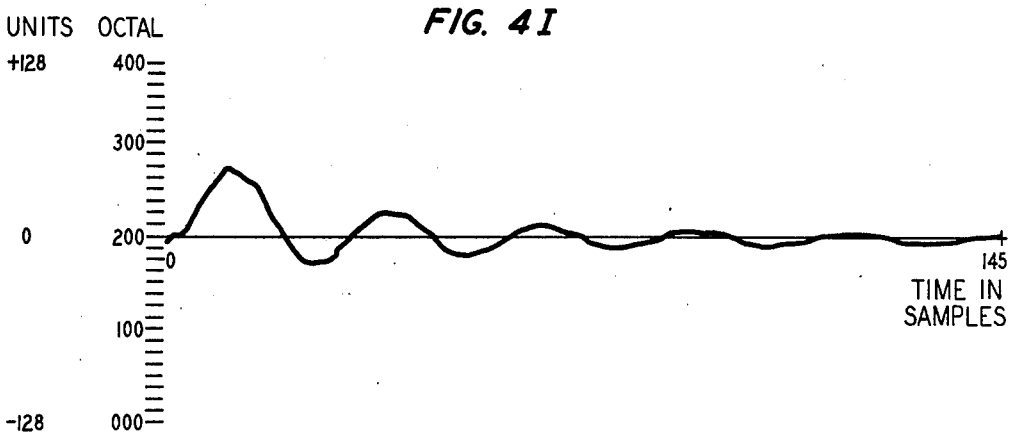
Figure 4J:
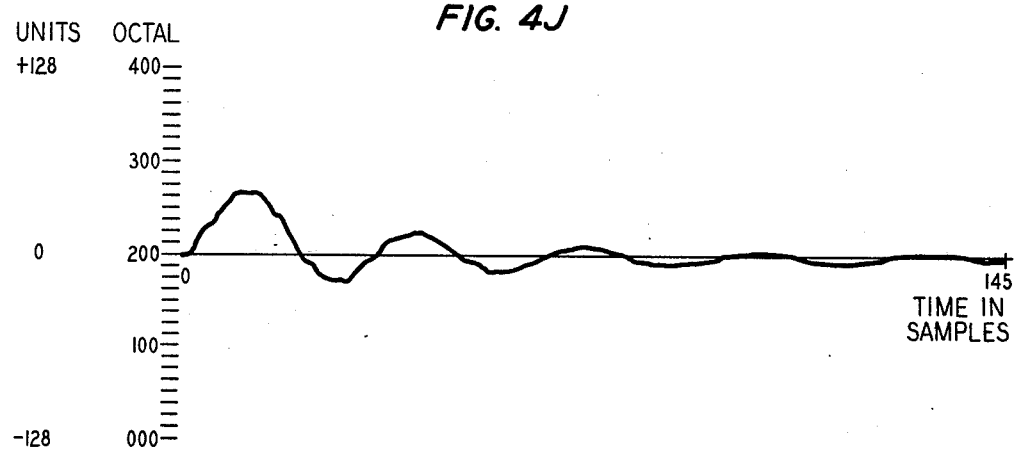
Figure 4K:
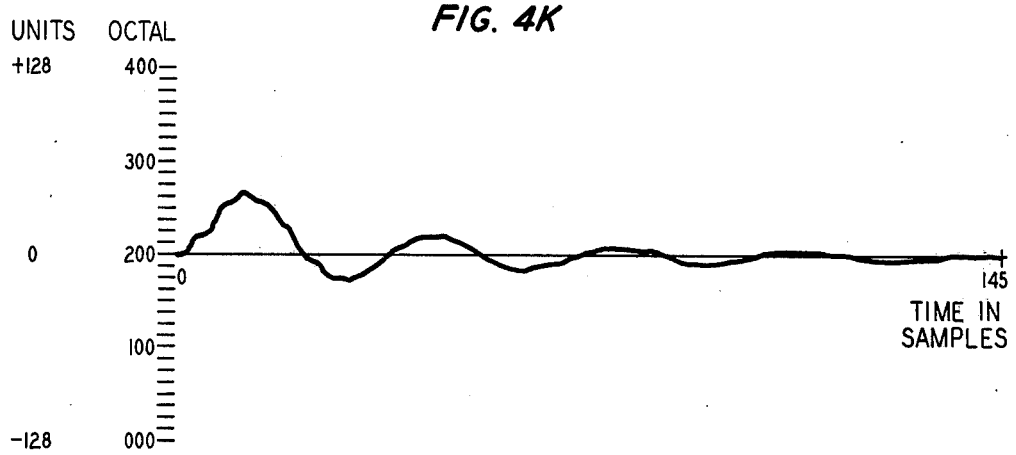
Figure 4L:
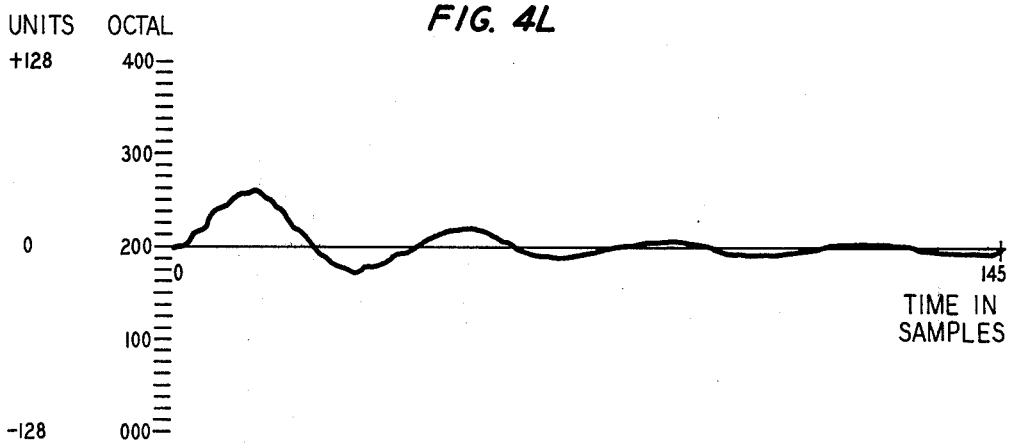

Referring now to FIG. 3, there is shown formant F1 versus formant F2 frequencies on log-log scale axes for locating frequency components of various voiced sounds. The first formant frequency F1 for various vowels and dipthong sounds range from approximately 200 Hz to approximately 900 Hz. The second formant frequency F2 for the same sounds range from approximately 600 Hz to approximately 2700 Hz. Although not shown in FIG. 2, the third formant frequencies F3 for those same sounds range from approximately 2300 Hz to approximately 3200 Hz. For voiced sounds and dipthongs, twelve waveform segments labeled $d_1(0)$ through $d_1(11)$ are selected at substantially equidistant data points along a single straight line 46 which traverses the formant F1 versus formant F2 parameter space on a slope $m=-1$.

Each one of the twelve data points $d_1(0)$ through $d_1(11)$ on the line 46 in FIG. 3 identifies the formant F1 and formant F2 frequencies of a different one of the basis functions $d_1(n)$. A basis function waveform segment is stored in the memory 18 of FIG. 1 for each basis function. Each basis function waveform segment lasts for the duration of an 18.25 millisecond basic pitch period. For each basis function waveform segment, 146 amplitude samples provide information relating to component waveforms of as many formant frequencies as desired. One way to store such basis function waveform segments is by periodically sampling the amplitude of the appropriate waveform at a basic sampling rate, such as 8 kilohertz, and thereafter encoding the resulting amplitude samples (for example, in 8-bit digital words, which quantize each sample into one of 256 amplitude levels).

FIGS. 4A through 4L show the voiced sound waveform segments for the basis functions $d_1(0)$ through $d_1(11)$. In FIGS. 4A through 4L, the waveforms are plotted on a vertical axis having the amplitude shown on two scales. One vertical scale is in scalar units representing the amplitude levels, and the other is those scalar units in octal code. The horizontal scale in FIG. 4 is time in samples.

Figure 5A:
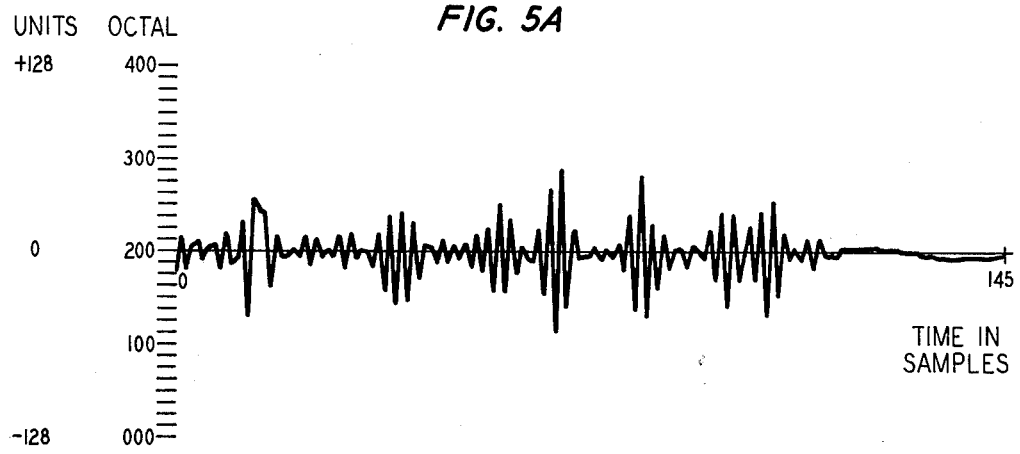
FIGS. 5A and 5B show basis function waveform segments representing data points not shown in FIG. 3.
Figure 5B:
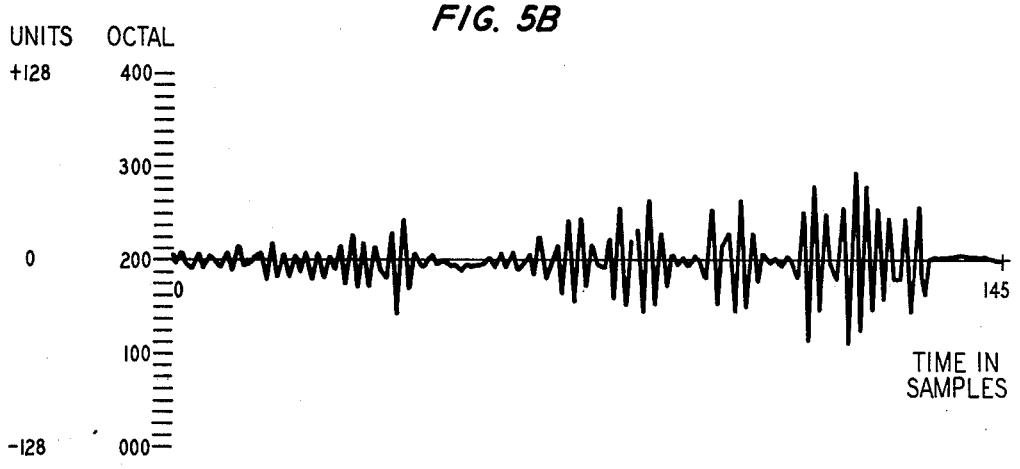

FIGS. 5A and 5B show unvoiced sound waveform segments for basis functions $d_1(12)$ and $d_1(13)$. These basis functions are plotted similarly to the other basis functions. Data describing each of the two unvoiced sound basis functions $d_1(12)$ and $d_1(13)$ also is stored in the memory 18 of FIG. 1 with the other basis functions. The same 18.25 millisecond duration applies to these two basic functions even though they do not have a repetitive pitch period associated with them.

Although recorded data representing the fourteen basis functions is no more than waveform segments describing twelve sample points for voiced sounds along the sloped line 46 in FIG. 3 plus waveform segments describing two unvoiced sounds, these basis functions together with some additional parameter data provide the basic information for generating a large vocabulary of good quality complete sound waveforms. Voiced sound waveform segments correlating substantially with the basis functions are generated in the arrangement of FIG. 1 by reading the basis function data from memory 18 and transmitting it through the microprocessor 15 and input/output device 20 to the digital-to-analog converter 11 at the sampling, or basic recording rate, and reconstructing the waveform directly.

Referring once again to FIG. 3, it is noted that a large portion of the rectangle surrounding the relevant parameter space for voiced sounds is not covered by the data points representing the basis functions $d_1(0)$ through $d_1(11)$. Voiced sound waveform segments representing sounds located at points off of the sloped line 46 in FIG. 3 are approximated by selecting one of the basis functions, reading it out of memory 18, and transmitting it through the microprocessor and input/output device 20 to digital-to-analog converter 11 at a rate different than the basic recording rate.

By employing a well known Laplace transformation $1/a[f(t/a)]=F(as)$, time compression and time expansion can be used for linearly scaling the frequency domain thereby scaling formant frequencies up or down. Any basis function is time compressed by reading it out at a faster rate than the basic recording, or basic storage, rate and is time expanded by reading it out at a slower rate than the basic storage rate. In FIG. 3, time compression of the basis functions is used for generating waveform segments identified by a matrix of points within the rectangle but located above and to the right of the basis function line 46. Time expansion is used for generating waveform segments identified by a matrix of points within the rectangle but located below and to the left of the basis function line 46.

Unvoiced sound waveform segments different than the two basis functions $d_1(12)$ and $d_1(13)$ also can be generated by similarly compressing and expanding those two waveforms.

Complete sound waveforms are produced by concatenating selected ones of the waveform segments produced upon command. Such complete sound waveforms can include both voiced sounds and unvoiced sounds.

Besides the amplitude sample information just described, more information is needed to describe a complete voice sound. Every complete spoken sound includes a concatenation of many waveform segments generated from selected ones of the fourteen basis functions. The apparatus of FIG. 1 follows a prescribed routine for generating any desired complete sound from the basis functions. A listing of the basis functions in the sequential order of their selection is stored in the memory 18 of FIG. 1 in a data table, called Table A. The number of basis functions to be concatenated for each complete voice sound can vary widely, but the data table includes a listing of some number of 24-bit data points for each of the words, or complete voice sounds, to be generated.

FIG. 6 presents Table A illustrating a list of data representing the complete waveform, for instance, for the sound of the word "who". Three bytes of data are used for representing each data point, or waveform segment, to be concatenated into the complete sound waveform. These data points are listed in sequential order from Point 1 through Point N.

For each data point, the four least significant bits 55 of the first byte identify which of the fourteen basis functions $d_1(n)$ is selected for generating the waveform. The four most significant bits 60 of the first byte identify what amount of time compression or time expansion in terms of a compression/expansion coefficient $d_2(m)$ is to be used to achieve a desired basis function readout period. Compression/expansion coefficients for the chart of FIG. 3 are given in Table B.

TABLE B

| Compression/Expansion Coefficient | |
|---|---|
| Coefficient | Value |
| $d_2(0)$ | .755 |
| $d_2(1)$ | .844 |
| $d_2(2)$ | .918 |
| $d_2(3)$ | 1.00 |
| $d_2(4)$ | 1.09 |
| $d_2(5)$ | 1.18 |
| $d_2(6)$ | 1.29 |
| $d_2(7)$ | 1.40 |

Referring once again to FIG. 6, the second byte 65 for each data point defines the pitch period as one of 256 possible periods of time. This pitch period is used to truncate or elongate its associated reconstructed basis function waveform segment depending upon the relative length of the basis function readout period and the pitch period.

Another data point waveform is concatenated to its immediately preceding waveform segment upon the termination of the preceding waveform segment at the end of the pitch period. The third byte 70 for each data point identifies which one of 256 amplitude quantization levels is to be used for modifying the waveform segment amplitude being read out of the basis function table.

Amplitude and pitch information relating to any desired sound can be determined by a known analysis technique. See *Journal of Acoustic Society of America,* Vol. 47, No. 2 (Part 2), pp. 634–648 (1970).

All of the data representing the fourteen basis functions is stored in the memory 18 of FIG. 1, where it is located by respective basis function addresses. The 146 data words representing the amplitude samples of any one basis function are stored in consecutive addresses in the memory 18 of FIG. 1.

FIG. 7 presents a 28-byte Table 1 used for indirectly addressing the basis functions. Table 1 stores fourteen two-byte addresses identifying the absolute starting, or initial, address of each of the fourteen basis functions in a Table 2 to be described. The addresses specified in Table 1 are selected by the microprocessor 15 of FIG. 1 in response to basis function parameter $d_1(n)$ which is stored in the Table A of FIG. 6.

FIG. 8 presents an illustration of Table 2 for storing basis function data. As previously mentioned the consecutive coded amplitude samples are stored in sequential addresses for each basis function $d_1(n)$. All of the amplitude samples for each basis function can be read out of the memory 18 of FIG. 1 by addressing the initial sample, reading information out of it and the subsequent 145 addresses. Therefore the fourteen addresses provided by Table 1 are sufficient to locate and read out of memory 18 all of the basis function data upon command.

Referring once again to FIG. 1, the circuit arrangement generates selected sounds from the data stored in the data point table, called Table A, and in the basis function table, called Table 2. An applications program also is stored in the memory 18. The memory is connected with the microprocessor 15 which controls the selection, the routing and the timing of data transfers from Table A and Table 2 in memory 18 to and through the microprocessor 15 and the input/output device 20 to the digital-to-analog converters 11 and 12.

Although the operations described for processing basis function data to form uttered sounds may be carried out using many apparatus arrangements and techniques, an Intel 8080A microprocessor, an Intel 8255 input/output device and Motorola MC1408 digital-to-analog converters have been used in a working embodiment of the arrangement of FIG. 1. The memory was implemented in random access memory and read only memory. The random access memory is provided by an Intel 2102 device, and the read only memory by four or more Intel 2708 devices. One 2708 memory device is used for the applications program, two 2708 memory devices are used for storing Tables 1 and 2 and one or more additional 2708 devices are used for storing the word lists of Table A.

In the working embodiment, an address bus 30 interconnects the microprocessor 15 with the memory 18 for addressing data to be read out of the memory and interconnects with the input/output device 20 for controlling transfers of information from the microprocessor to the input/output device 20. An eight-bit data bus 31 interconnects the memory with the microprocessor for transferring data from the memory to the microprocessor upon command. The data bus 31 also interconnects the microprocessor 15 with the input/output device 20 for transferring data from the microprocessor to the input/output device at the basis function readout rate specified by the compression/expansion coefficient $d_2(m)$ given in Table A.

Figure 9:
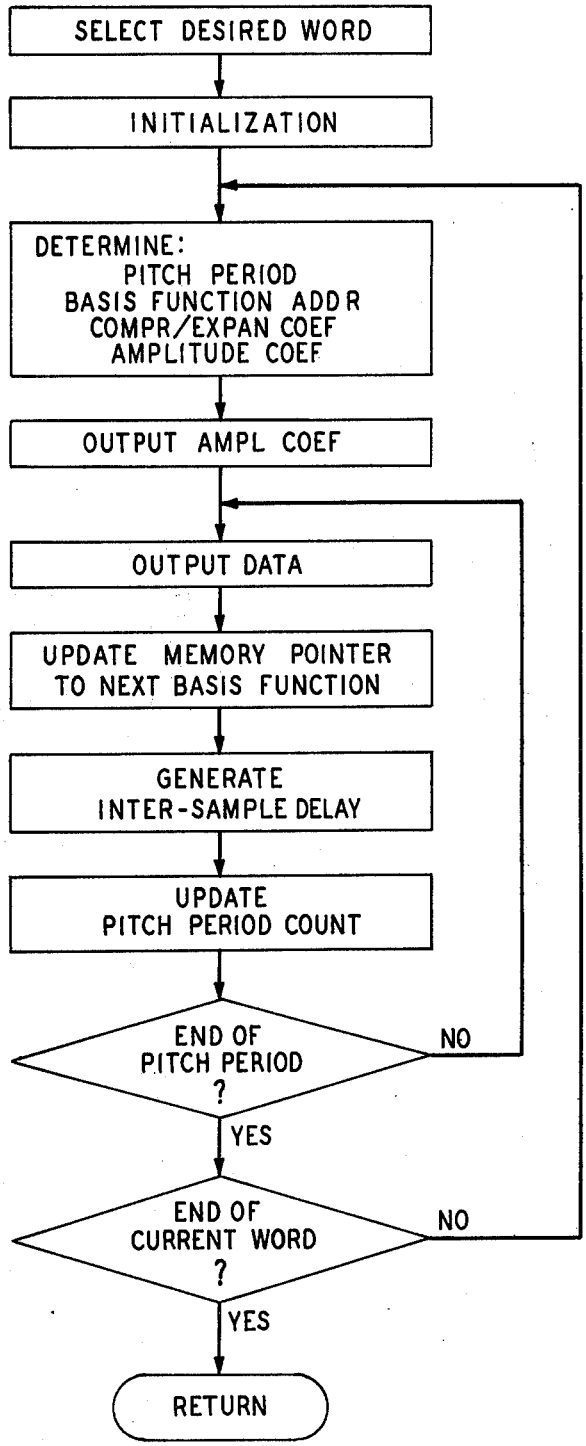
FIG. 9 is a flow chart showing steps in the process of producing synthesized voice waveforms.

A flow chart of the programming steps used for converting the microcomputer apparatus into a special purpose machine is shown in FIG. 9. Each step illustrated in the flow chart by itself is well known and can be reduced to a suitable program by anyone skilled in programming art. The subroutines employed in reading out basis functions to synthesize speech waveforms are set forth in Appendices A, B and C attached hereto.

Sample amplitude information from the basis function Table 2 in memory 18 passes through the microprocessor 15, the data bus 31, the input/output device 20, and an eight-bit data bus 32 to the digital-to-analog converter 11 at the basis function readout rate. This amplitude information is in digital code representing the amplitudes of the samples of waveform segments. Amplitude information read out of the Table A for modifying the amplitude of the basis function waveform segments is transferred from the memory through the microprocessor to the input/output device 20 which constantly applies the same digital word through an eight-bit data bus 33 to a digital-to-analog converter 12 for an entire pitch period. The digital-to-analog converter 12 produces a bias signal representing the amplitude modifying information and applies that bias to the digital-to-analog converter 11. The digital-to-analog converter 11 is arranged as a multiplying digital-to-analog converter which modifies the amplitude of basis function signals according to the value of bias applied from digital-to-analog converter 12. Once the amplitude modifying information is applied to the digital-to-analog converter 12 at the beginning of any pitch period, the series of 146 sample code words representing a basis function are transferred in succession from the microprocessor 15 through the input/output device 20 to the digital-to-analog converter 11, which generates the desired amplitude modified basis function waveform segment for one pitch period from the 146 sample code words of the basis function.

It is noted again that the rate of readout of the 146 sample code words may be either the same as, faster than, or slower than the basic 8 kHz sampling, or storage, rate used for taking the amplitude samples. This readout rate variation is accomplished by the microprocessor 15 in response to the compression/expansion coefficient $d_2(m)$ for the relevant period.

By speeding up the readout rate, the arrangement of FIG. 1 constructs a waveform that is a time compressed version of the selected basis function. This time compressed version of the basis function is an approximation of an actual waveform segment for a different point of the formant F1 versus formant F2 axes of FIG. 3. For instance, by choosing basis function $d_1(0)$ located at data point 55 in FIG. 3 and time compressing it with a compression/coefficient $d_2(7)$, there is generated a waveform segment approximating a desired actual waveform for a point 60 on the formant F1 versus formant F2 axes. This generated waveform segment, identified as point 60, is produced from basis function $d_1(0)$ and compression/expansion coefficient $d_2(7)$.

By slowing down the readout rate of the basis function information, the circuit of FIG. 1 constructs a waveform segment that is a time expanded version of the selected basis function. This time expanded version of the basis function also is an approximation of an actual waveform segment for a different point on the formant F1 versus formant F2 axes of FIG. 3. By choosing basis function $d_1(0)$ at data point 55 in FIG. 3 and time expanding it with a compression/expansion coefficient $d_2(0)$, the arrangement of FIG. 1 generates a waveform segment approximating a desired actual waveform for a point 62 on the formant F1 versus formant F2 axes.

It is noted that the arrangement of FIG. 1 simultaneously operates on plural formant frequencies as it compresses or expands the waveform segments. The arrangement accomplishes this simultaneous compression or expansion because the slope of the basis function line 46 on the formant F1 versus formant F2 axes has a slope $m=-1$. Time compression or time expansion are applied uniformly to both formant F1 and formant F2 characteristics because the compression and expansion processes operate along lines perpendicular to the basis function line 46. These lines perpendicular to the line 46 each form a locus which maintains the ratio between the formant F1 and F2 frequencies.

It should be noted that the readout rate determines how rapidly the generated waveform segment decreases in amplitude. The pitch period information read out of Table A in FIG. 6 determines when to terminate its associated waveform segment. As previously mentioned, the waveform segment amplitude information for modifying the generated waveform is applied by the input/output device 20 to the digital inputs of the digital-to-analog converter 12 as a coefficient for determining a bias for modifying the amplitude of the waveform segment to be generated by the digital-to-analog converter 11. In this arrangement the digital-to-analog converter 12 operates as a multiplying digital-to-analog converter.

The resulting output signal produced by digital-to-analog converter 11 on line 40 is an analog signal which is applied to some type of electrical to acoustical transducer shown illustratively in FIG. 1 as a low-pass filter (LPF) 41 and the speaker 13. The low-pass filter 41 is interposed between the digital-to-analog converter 12 and the speaker 13 for improving quality of resulting sounds. The improved quality of the sound results from filtering out undesired high frequency components of the sampled signal. Speech sounds synthesized by the described arrangement have very good quality even though a limited amount of memory is used for storing all of the required basic parameters and a limited amount of relatively inexpensive other hardware is used for constructing all desired waveform segments.

Storage capacity for the synthesizer of FIG. 1 is determined very substantially by the size of the vocabulary desired to be generated. Memory capacity depends upon the size of Table A of FIG. 6 which includes descriptive information for all uttered sounds to be generated.

In FIG. 9 there is shown a flow chart which outlines the sequence of steps that occur during the generation of a complete uttered sound to be synthesized by the circuit arrangement of FIG. 1 operating under control of a program as listed in Appendices A and B. The beginning of the listing in Appendix A contains general comments and definitions of terms.

In FIG. 9 the first step shown is the selection of the uttered word desired to be synthesized. Such selection is made prior to commencement of control by the program listed in Appendices A and B.

Subsequent to the selection of the desired word, the program control commences immediately following a comment "start". Wordx is initialized and a word pointer established. The microprocessor thereby identifies the location of the portion of Table A describing the selected word. As previously mentioned, Table A contains a list of 3-byte data points for every sound desired to be synthesized.

After the microprocessor is initialized, control continues with the third step shown in FIG. 9. This commences a large outer loop in the flow chart and the block of code labeled DOLOOP1 in Appendix A. In this step of the processing, the system of FIG. 1 determines specific information to be used during the first pitch period of the selected word. This information includes the duration of that pitch period, the address of the selected basis function, the compression/expansion coefficient and the amplitude coefficient to be used for generating the first waveform segment. All of this information is transferred from the memory 18 to the microprocessor 15 with the system operating under control of the block of code in Appendix A commencing with DOLOOP1 and ending just prior to DOLOOP2.

During the sequence of DOLOOP1, the microprocessor commences to output the amplitude coefficient to the input/output device for the entire pitch period. The pertinent block of code follows an identifying comment within the block of code DOLOOP1 in Appendix A.

Within the large loop of FIG. 9, there is a smaller enclosed processing loop. This enclosed loop is called DOLOOP2 in the code of Appendix A. At the beginning of the smaller enclosed loop the microprocessor outputs a sample value of a basis function to the input/output device. This step is followed sequentially by updating of the memory pointer to the next sample each time data is processed through the smaller enclosed loop until the basis function is completely read out. The next step is the generation of inter-sample delay period depending upon what compression/expansion coefficient is being applied. The enclosed loop is terminated by an update of the pitch period count and a decision of whether the pitch period is over or not. If the pitch period is not complete, the control returns to run through DOLOOP2 again. If the pitch period is complete, the system checks whether the selected word has been completely synthesized. If the word has not been completely synthesized, control returns through the larger loop to determine parameters required for the next waveform segment. Otherwise control is returned to the executive program.

Appendix B lists a block of code for determining an appropriate delay period which is used in the generation of inter-sample delay during the running of DOLOOP2.

Appendix C is a routine which is used for establishing tables in memory. The program listings of Appendices A, B and C are written in 8080A assembly language. That language is presented in INTEL 8080A Assembly Language Programming Manual, INTEL Corporation, Santa Clara, Calif. (1976).

The foregoing description presents in detail the arrangement and operation of an illustrative voice synthesizer embodying the invention. This embodiment, together with other embodiments obvious to those skilled in the art are considered to be included within the scope of the invention.

APPENDIX A

```
/* This program implements the "waveform synthesis"
   technique for voice generation. There are 4 basic
   parameters. The symbol id1 relates to one of 14,
   18.5 msec. time waveforms or otherwise called basis
   functions. Twelve basis functions are for voiced
   segments and two basis functions are for unvoiced
   segments. Each function has 146 samples at
   125 microsec. points. The symbol id2 relates to
   the time compression parameter. Finally, phr and
   amp relates to the pitch and amplitude of the basis
   function. */
vcsy:
phr=.                    /* Scaled pitch period in terms of the
                            pitch period divided by intsmp */
.=.+1
amp=.                    /* Amplitude coefficient */
.=.+1
intsmp=.                 /* Inter-sample period */
.=.+1
mptr=.                   /* Memory pointer */
.=.+2
addst=.                  /* Word data pointer start */
.=.+2
adden=.                  /* Word data pointer end */
.=.+2
wordx=.                  /* Word data pointer index */
.=.+2
templ=.                  /* Temporary storage */
.=.+1
                         /* Start */
LHLD addst               /* Initialize wordx. */
SHLD wordx               /* Word data pointer */
DOLOOP1
MOV A,M                  /* Get id2. */
RRC
RRC
RRC
RRC
ANI 007                  /* Mask Lower 3 bits and store in B. */
MOV B,A
MOV A,M                  /* Get id1 and leave in E. */
ANI 017
MOV E,A
INX H
MOV C,M                  /* Get pitch period, phr. */
INX H
MOV D,M                  /* Get amplitude coefficient, amp. */
INX H
```

APPENDIX A-continued

```
SHLD wordx          /* Store incremented word data pointer. */
LXI H, phr
MOV, M,C            /* Store parameters. */
INX H
MOV M,D
INX H
MOV M,B
                    /* Load memory pointer, mptr. */
MOV A,E             /* Retrieve id1. */
ADD A               /* Multiply by two. */
LXI H,BASFT1        /* Point to start of Table 1. */
LXI D,O
MOV E,A
DAD D               /* HL picks up the basis function
                       address from Table 2. */
MOV E,M
INX H
MOV D,M
XCHG
SHLD mptr           /* 16 bit assignment */
                    /* Output amplitude coefficient. */
LDA amp
OUT OO
                    /* Reset temporary sample count. */
MVI A,O
STA templ
DOLOOP2:
MOV A,M
OUT 01              /* Output the sample value. */
INX H
LDA templ
INR A
CPI 146             /* Check for completion of basis function
                       table. */
JNZ LINE7
DCX H
JMP LINE8
LINE7:
STA templ
LINE8:
LDA intsmp          /* if id2=0 then delay is 104+74=
                       178 microsec. If id2=7 then delay
                       is 27+74=101 microsec. */
OFFSET EQU 247
ADI OFFSET          /* Add offset to delay routine. */
CALL delay
LDA phr
DCR A
STA phr
JNZ DOLOOP2
                    /* Check end of word. */
LHLD adden
XCHG                /* end address in DE */
LHLD wordx          /* word index in HL */
                    /* Subtract two 16 bit quantities. */
MOV A,E
SUB L               /* E-L */
MOV A,D
SBB H               /* D-H-CH */
JP DOLOOP1
ret
```

APPENDIX B

```
delay:
                    /* This is a time delay routine. Incoming
                       register A contains the delay count.
                       Time delay=2821-11x microseconds. */
dly:
ANI 03777           /* 7 cycles */
INR A               /* 5 cycles */
JNZ dly             /* 10 cycles */
ret                 /* 10 cycles */
```

APPENDIX C

```
fmtbl:
                    /* This routine generates Table 1.
                       Table 1 points to the starting
                       location of each basis function in
```

APPENDIX C-continued

```
                       Table 2. Table 1 is located in the
                       first 28 locations after BASFT1.
                       Table 2 is located at location
                       BASFT2 and spans 146 words times
                       14 basis functions for a total of
                       2044 locations. */
temp2=.
.=.+1
LXI H,BASFT2        /* starting location of Table 2 */
LXI B,146           /* basis function length */
LXI D,BASFT1        /* starting location of Table 1 */
MVI A,14
STA temp2
cont:
MOV A,L
STAX D
INX D
```

APPENDIX C-continued

```
MOV A,H
STAX D
INX D
DAD B
LDA temp2
DCR A
STA temp2
JNZ cont
ret
```

I claim:

1. A voice synthesizer (FIG. 1) arranged with a memory (18) for storing basis functions (FIGS. 4A through 4L), each basis function including a set of data representing a speech waveform segment recorded at a basic storage rate and each basis function defining a waveform segment within a pitch period and including plural formants F1 and F2; the synthesizer BEING CHARACTERIZED BY each basis function being represented by a data point plotted on a single line (46) on a chart having first and second formant log-log axes (FIG. 3), and means (11, 12, 13, 15, 20, 30, 31, 32, 33, 36, 40, 41) for producing a speech waveform segment within the pitch period and approximately representing a data point located off of the single line (46) on the chart by selecting and reading out of the memory (18) in the pitch period one of the basis functions at a rate different than the basic storage rate.

2. A voice synthesizer in accordance with claim 1 wherein the line (46) on the chart is further characterized as a straight line having a slope $m=-1$ on the log-log axes.

3. A voice synthesizer in accordance with claim 1 wherein the memory (18) further comprises a section storing a data point table (FIG. 6) including a list of data points describing a complete sound to be synthesized, a first table (FIG. 7) including a list of addresses, each address locating an initial storage position of a sequence of storage positions of a different one of the basis functions, and a second table (FIG. 8) including a list of basis function data, the producing means is further characterized by a microprocessor (15) interconnecting with the memory (18) by way of an address bus (30) and a data bus (31), the microprocessor being responsive to data read from the data point table (FIG. 6) and the first table (FIG. 7) for controlling transfer of selected basis function data from the second table (FIG. 8) to the microprocessor, an input/output device (20) interconnecting with the microprocessor by way of the data bus (31) for receiving the selected basis function data from the microprocessor, and a first digital-to-analog converter (11) interconnecting with the input/output device by way of data bus means (32) for receiving the selected basis function data from the input/output device, the first digital-to-analog converter being responsive to the selected basis function data for generating an analog waveform segment approximately representing a desired data point.

4. A voice synthesizer in accordance with claim 3 wherein the microprocessor (15) is further characterized by operating in response to a time compression/expansion coefficient (60) fetched from the data point table (FIG. 6) for determining the rate of transmitting basis function data from the microprocessor to the input/output device.

5. A voice synthesizer in accordance with claim 3 wherein the producing means is further characterized by a second digital-to-analog converter (12) interconnecting with the input/output device (20) by way of data bus means (33), the second digital-to-analog converter (12) being responsive to an amplitude coefficient (70) fetched from the list of the data point table (FIG. 6) for producing a bias signal, the first digital-to-analog converter (11) being further responsive to the bias signal for modifying the amplitude of the analog waveform segment representing the desired data point.

6. A voice synthesizer arranged with a memory for storing basis functions, each basis function including a set of data representing a speech waveform segment recorded at a basic storage rate and each basis function defining a waveform segment within a pitch period and including plural formants F1 and F2; the synthesizer being characterized by means for reading out the basis functions at a readout rate that is varied from pitch period to pitch period, different readout rates producing different speech waveform segments within the pitch period and including formants F1 and F2.

* * * * *